United States Patent [19]

Hutchinson

[11] 4,445,321

[45] May 1, 1984

[54] TENDON CONSTRUCTION FOR POSTTENSIONING PRESTRESSED CONCRETE AND THE METHOD OF MAKING SUCH TENDONS

[76] Inventor: Raymond E. Hutchinson, 51 Adelphi Ave., Providence, R.I. 02906

[21] Appl. No.: 445,278

[22] Filed: Nov. 29, 1982

[51] Int. Cl.[3] ..... D07B 1/16; D07B 1/14

[52] U.S. Cl. ..... 57/223; 57/7; 427/409

[58] Field of Search ..... 57/200, 210, 212, 213, 57/217, 221, 223, 232, 258, 6, 7, 295, 296; 427/409

[56] References Cited

U.S. PATENT DOCUMENTS

| | | | |
|---|---|---|---|
| 3,646,748 | 3/1972 | Lang | 57/223 |
| 3,885,380 | 5/1975 | Hacker | 57/223 X |
| 3,899,384 | 8/1975 | Kelly | 57/223 X |
| 3,922,437 | 11/1975 | Kitta et al. | 57/223 X |
| 4,123,894 | 11/1978 | Hughes et al. | 57/221 X |
| 4,125,741 | 11/1978 | Wahl et al. | 57/213 X |

*Primary Examiner*—Donald Watkins
*Attorney, Agent, or Firm*—Robert J. Doherty

[57] ABSTRACT

A tendon for use in posttensioning prestressed concrete comprising a multi-wire strand wherein individual peripheral abutting wires define an overall somewhat regular geometric cross-sectional strand configuration. The strand has both internal and external interstices wherein said external interstices are substantially fully filled with a dielectric plastic material such as a high molecular polyolefin material such as high density polyethylene. The plastic material forms a casement which completely surrounds the strand and forms a smooth outer surface having a circular cross-sectional configuration. A friction reducing grease-like material is coated on the outside of the casement and the entire structure thereafter enclosed in a plastic jacket. The above structure is formed by progressively extrusion coating the wire strand with the dielectric plastic, the thus coated strand with the grease-like material and the thus coated composite with plastic to form the jacket.

9 Claims, 4 Drawing Figures

TENDON CONSTRUCTION FOR POSTTENSIONING PRESTRESSED CONCRETE AND THE METHOD OF MAKING SUCH TENDONS

BACKGROUND AND OBJECTS OF THE INVENTION

This invention relates to a strand and more particularly to a multiple-wire strand formed of high-tensile steel suitable for use in posttensioning prestressed concrete members or structures.

Although concrete has been utilized as a structural material since ancient time, it has been only recently (in the past 100 years) that concrete has been used as a primary building material. This advance was possible by the use of reinforcing iron bars placed in the lower parts of wooden forms which provided the required tension for girders, beams, and flooring after the concrete had been poured and hardened and the forms removed. This enabled the design and utilization of concrete members for use under both tension and compression conditions and led to the subsequent stressing of the concrete itself (prestressed concrete). Prestressed concrete is the name applied to concrete products that have been compressed by either pretensioning or posttensioning of high tensile steel wires, rods or strands that remain permanently imbedded in the concrete to couple the properties of tension, shear and torsion to the compression property of concrete.

There are two techniques used for prestressing concrete: Pretensioning and posttensioning. Pretensioning is usually restricted to high volume products that can readily be transported from point of manufacture to erection site. The forms used are equipped with high-strength bulkheads through which the uncovered, bare, and clean steel members are threaded and stressed. After stressing, the concrete is poured. High-early concrete is formulated for overnight curing (with heat if necessary) to a strength (usually 4000 P.S.I.) to grip and withstand the pressure of the steel when released from the bulkheads without crushing said concrete.

Posttensioning, or tensioning the steel members after pouring and hardening of concrete, can be produced in forms as described above, as well as in temporary forms at the construction site, by placing coated high tensile steel tendons in said forms in desired position after which the concrete is poured and given time to set up and cure to the point that it will withstand the stress that develops when the high-tensile tendons are stretched tight. This process requires that one tendon end be held securely while pulling the opposite end with a jacking device until the steel is elongated within its elastic limit (about 30,000 to 33,000 pounds on a ½" 7-wire strand of high carbon, high-tensile steel).

Presently a tendon in wide use is that described in U.S. Pat. No. 3,646,748 in which a high-tensile strand is encased in petroleum based grease or other lubricating corrosion inhibitors to protect the strand from corrosion as well as from abrasion by the encompasing concrete during tensionsioning of said strand. The thus grease coated strand is then provided with a tight fitting plastic jacket. These tendons are produced by passing the strand through a grease filled container just ahead of the extruder. The spiral convolutions of the outer wires of the strand scrape grease off the inner wall of the hole produced in the grease by the lineal passage of the strand. Because this application of grease is performed at the extrusion rate of up to 300 feet per minute, the actual time span of the strand in a grease container of about two feet long is less than one-half second, which results in the grease filling only the outer portions of the strand interstices and no grease in the inner voids. Because a tight jacket is extruded over the grease encased strand, a slight positive pressure is immediately exerted on the grease which then starts to migrate to the inner voids very slowly. The vibrations of shipping, the warmth of sun exposure, and the flexing of the strand during make-ready activity or otherwise during the time span prior to use will move the grease into the inner voids thus reducing the intended protection of the strands by enabling the jacket to enter the convolutions of the spiraled outer strand wires resulting in a more generally hexagonal-shaped tendon and thus an appreciable amount of additional friction during tensioning of the strand.

Also since these prior art tendons are encased in grease prior to plastic jacketing, they cannot be used in those instances of posttensioning where one end, 6 to 8 feet long, must be imbedded in concrete which when hardened, will mechanically interlock with the bare, clean strand to the extent that the other end can be hydraulically jacked to exert a 30,000 pound pull on a ½" tendon. One application for this type of tendon is the concrete transmission poles used in long distance power transmission. A typical pole may require 32 tendons in the 30" square base and only 12 in the 10" square top. Twenty tendons are imbedded in a staggered pattern in that section that is 30 to 60 feet from the base. In spite of all efforts of wiping, brushing, dissolving with solvents or heating, the grease applied to present tendons remains on the strand to such extent that 8 feet exposed to the concrete will not be gripped sufficiently to prevent pulling the strand out of the concrete during posttensioning and the transmission pole is a total loss.

Also because most tendons are intentionally placed in an arc or curve, the strand during initial stressing forces the grease away from the point of contact of strand to plastic jacket and as tensioning continues, the strand, which is elongated about 8.4 inches per 100 feet of length rubs and abrades through the comparatively fragile plastic jacket to the concrete which adds greatly to friction and results in damage to the strand. In addition, the use of grease or corrosion inhibitor having grease-like consistency is widely used for its anti friction property but provides no support to maintain centrality of strand in tendon during tensioning.

It is therefore an object of the present invention to provide a tendon of improved construction which overcomes the above-discussed prior art shortcomings. This and other objects are accomplished by the provision of a tendon for use in poststressing concrete comprising a multiple-wire strand wherein individual peripheral abutting wires define a roughly geometric overall cross-sectional strand configuration having both internal and external interstices wherein said interstices are open ended crevices defined between adjacent wires, an encasement formed of a dielectric plastic completely surrounding the outside of said strand to form a smooth outer surface of circular cross-sectional configuration and having internal portions extending into said strand crevices; a thin friction reducing layer of grease-like material on the outer surface of said encasement and a loose plastic jacket disposed over said encased strand whereby said strand may freely move longitudinally relative to said jacket.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
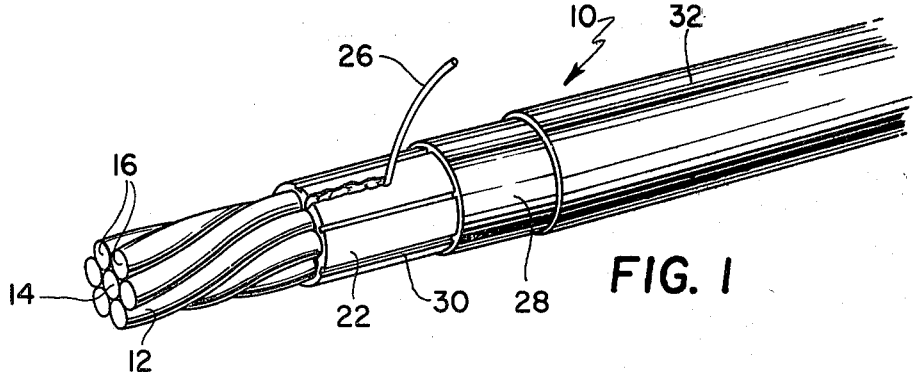
FIG. 1 is a perspective view with parts broken away for clarity of a tendon made in accordance with the present invention.
Figure 2:
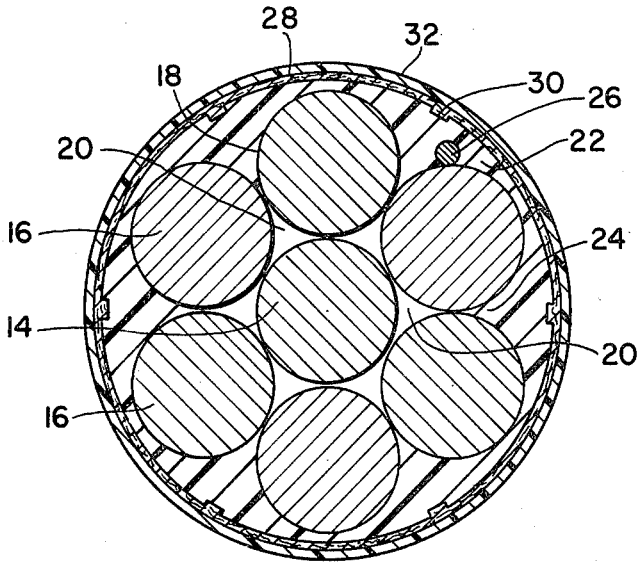
FIG. 2 is a cross-sectional view thereof on an enlarged scale.

Turning now to the drawing and more particularly to FIGS. 1 and 2 thereof, a preferred form of the present tendon construction is shown. Such tendon 10 includes a multiple-wire strand 12 composed of a central wire 14 and six wires 16 helically wrapped about the outside of the central wire 14. Such six around one configuration results in an overall cross-sectional shape of a somewhat hexagonal configuration. It should be pointed out that the multiple-wire strand 12 may be of any form. Normally, strands of about 0.375 to 0.625 inches in diameter are utilized since such are readily available from strand producers; however the features of the present invention will permit use of substantially larger diameter, i.e., up to 1" diameter, strand for heavier applications including road construction and the like wherein extremely long spans may be desirable. It is also preferable that the wire forming the strands be of high-tensile steel such that the tensile forces in the order of at least 30,000 pounds can be applied to an average diametered strand with ease and with a resultant approximate 8.4 inch lineal stretch developed in a ½" tendon 100 feet long.

The outer peripheral wires 16 generally contact each other in side to side abutting relationship as well as the central wire 14 so as to form a plurality of outer interstices or spiral crevices 18 spaced around the circumference of the strand and a plurality of internal interstices 20. A casement 22 formed of a diaelectric plastic such as polyethylene, polypropylene, and polyvinylchloride and the like, completely surrounds the strand 12 and includes inwardly projecting portions 24 which extend into the outer interstices or crevices 18. The outer surface of the encasement 22 is of circular cross-sectional configuration and thus the encased strand presents the appearance of a cylinder having a smooth outer surface. A fine wire 26 which ultimately acts as a rip cord may be positioned longitudinally along the strand beneath or embedded in the encasement 22 for a purpose which will be hereinafter more fully explained.

The outer surface of the encasement 22 is coated with a thin layer of friction-reducing grease-like material 28. Any suitable grease-like material which exhibits such anti-friction characteristics in the temperature use range of such tendons may be utilized; and it is not necessary that such grease-like materials include or exhibit corrosion resistent properties. The encasement 22 may also be provided with a plurality of longitudinally directed radially inwardly extending grooves 30 which may serve as a reservoir for such grease for a purpose which will hereinafter be made more apparent. Such grooves when utilized are preferably formed in a thicker encasement 22. The thus grease-coated encased strand is finally provided with an outer plastic jacket 32. Suitable plastic materials for forming the outer jacket 32 include the polyolefins expecially high-molecular weight polyethylene polymers and co-polymers of polyproprylene as well as those of polyvinylchloride. A suitable thickness for the tubing wall is in the order of 10 to 25 mils so as to be able to satisfactorily sustain normal shipping, handling, and general abuse when utilized as a post-stressing tendon in concrete.

The plastic materials of said insulative encasement 22 and said jacket 32 should be selected on the basis that the insulation be extremely low in moisture absorption such as high density polyethylene and the jacket be tough and abrasion resistant such as polypropylene. Other plastics including polymers and co-polymers of ethylene, propylene, nylon, teflon, and mylar can be substituted to meet design criteria or other specific requirements.

Figure 3:
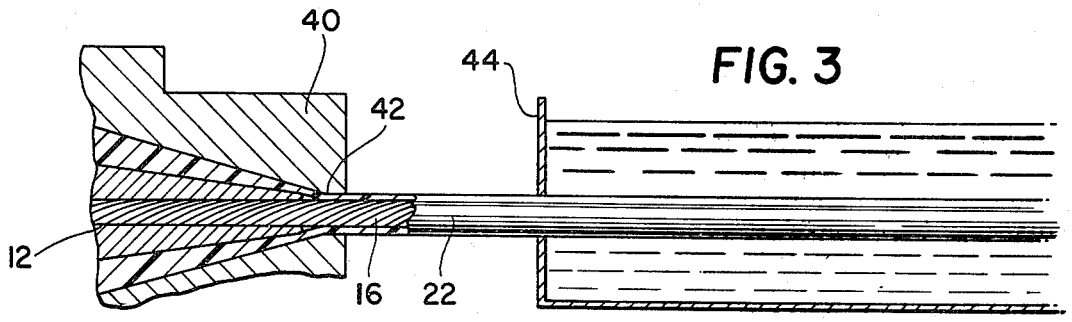
FIG. 3 is a schematic showing of the manner in which the plastic casement may be formed over the multiple-wire strand.
Figure 4:
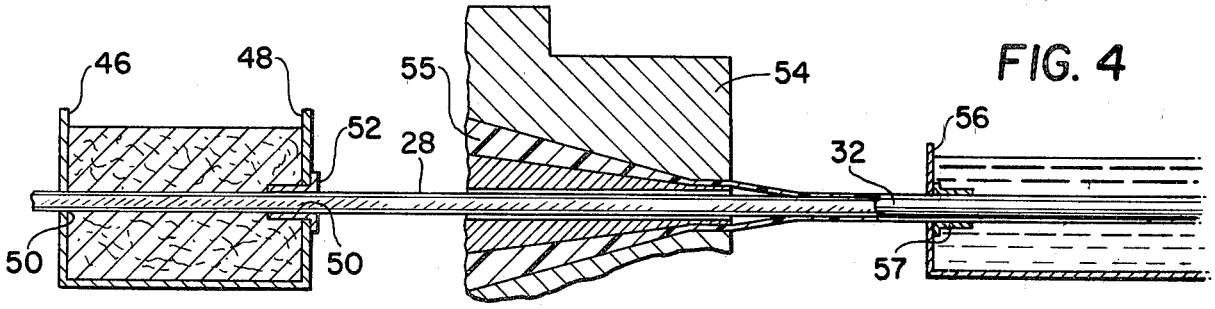
FIG. 4 is a similar schematic view showing the manner in which the layer of grease-like material and the outer jacket may be formed over the thus encased wire strand.

Turning now to FIGS. 3 and 4, suitable apparatus is shown for forming the encased tendon structure 10 of the present invention. Accordingly as shown in FIG. 3, the wire strand 12 is fed into a cross head extruder 40 of conventional design and through which a molten plastic such as high density polyethylene is extruded onto the outer surface of the wire under suitable pressure so as to be forced substantially entirely into the crevices 18. The thus coated strand thereafter passes through the shaping extrusion orifice 42 which determines the thickness of the encasement 22 and thereafter into a water quenching bath 44.

The strand may then either be fed into the apparatus of FIG. 4 or the operations depicted therein provided for at a remote location. In either event the encased strand is thereafter passed through a grease application device 46 including a storage container for a suitable grease including a pair of aligned orifices 50, the downstream orifice of which includes a wiping element 52 to insure that the proper and generally thin layer of grease is applied to the outer surface of the encasement 22. Thereafter, the thus greased encased strand is fed to a cross head extruder 54 similar to the extruder 40 discussed in relationship with FIG. 3 wherein a thin coating of another plastic 55 is applied over the encased and greased strand so as to form a jacket 32. The thus coated strand is then quenched in a cold water bath 56 which is preferably enclosed to establish a vacuum above the water so that the hot jacket from the extruder will effectively be formed to the I.D. of sizing sleeve 57 to produce a predetermined and exact O.D. of the jacket that will also assure a uniform loose fit over the greased core and thereafter the resultant tendon 10 wound upon a spool or other supporting element (not shown).

Because the novel tendon structure 10 described in this invention provides for the complete encasement of the strand 12 in a dielectric and inert plastic, it will not later migrate to the inner interstices 20 upon exposure to heat, rough handling, and the like. Thus, the present tendon 10 will retain its original round shape until it is placed and stressed in concrete regardless of the time lapse after extrusion rather than undesirably revert to a hexagonal shape as possible with prior art devices such as those described in U.S. Pat. No. 3,646,748.

In addition, because tendons by their very nature are still, heavy and difficult to handle, they are subject to abrasions, cuts, and damage before they are finally positioned in a concrete structure, that is, positioned in a form or the like for receiving pourable concrete which later hardens into the resultant concrete structure. Any cut in the outer jacket commonly used in present tendons results in grease exuding through the cut and loss of grease that decreases the intended protection of the strand. If a cut or abrasion is extensive, concrete may even come into intimate contact with an unprotected strand and result in an undesirable bonding between the strand and the concrete thus resulting in excessive friction at the time of tensioning.

The novel tendon of the present invention is protected against such damage with a complete encasement of plastic that absorbs and distributes external force to all the wire strands. Furthermore, the tendon of the present invention through the use of plastic encasement 22 insures that the circular cross-sectional shape is maintained such that the strand may be more easily moved relative to its outer jacket upon tensioning. In this regard, the optional use of the grooves 30 places reservoirs of grease 28 between the jacket 32 and the casement 22 so that grease is always available at points of stress in the tendon and in this way additionally provides for smooth relative movement between the strand and concrete upon strand tensioning.

Another feature of the present tendon construction is that since there is no grease encasement or application to the wire strand itself, full purposeful bonding between a portion of a strand that has been stripped bare of its jacket and encasement (32 and 22 respectively) and the concrete structure in which it is embedded can be achieved. This is particularly useful when forming structures such as transmission poles wherein continuous tendons cannot be installed the entire length of the structure and where it is necessary to bond a portion of a tendon end in order to form an interlock internally in the structure and the tendon is then stressed so that a pole or other structure of extremely long length can be progressively built. In that regard, the rip cord 26 may be utilized to initiate or complete a longitudinal cut through the encasement 22 and the jacket 26 after which those portions of the tendon 10 can be removed to lay bare the appropriate length portion of strand to form the mechanical interlock with the concrete. It should be brought out that the rip cord 26, although a convenient mechanism for initiating such cut, is not completely necessary and that the jacket and encasement could be removed using a knife or other implement. Also the cord 26 when used is laid longitudinally along the strand 12 such that it contacts the top portions of the spirally laid individual wires 16 as well as being at least to some extent forced down into the intermediate crevices 18 by the flow of plastic forming the encasement 22.

Another desirable feature of the tendon 10 of the present invention is that it completely encloses or encases the strand 12 in a dielectric material (encasement 22) such that electrical corrosion causing currents between the strand and its surroundings are reduced or eliminated. Also the above-described encasement makes it possible to load the internal voids (interstices 20) of the strand with lubricating oil, grease or the like (anti-corrosion material either separately or in combination with the lubricating medium can also be loaded into the strand) simply by forcing the medium under pressure into one end of the strand and observing it flow out the other end to determine filling. Such could not be done with currently used tendons inasmuch as the grease forced into the outer strand crevices works into the internal crevices and blocks the later flow of material longitudinally therethrough. Placement of lubricating material internally of the strand can be useful in reducing wire to wire friction, abrasion, etc. especially when the strand is radially bent, twisted, or the like in use.

Additionally, the novel tendon of the present invention provides a practical means of producing contiguous prestress slabs as in highways, airport runways, and other large structures that necessarily involves the assembly of many individual slabs. By imbedding the stripped and bared ends of tendons in the prior slab, the tendons can then be included in the subsequent slab, whose eventual tensioning will involve all prior slabs, producing an integrated, homogeneous assembly that will work together as one continuous prestressed concrete structure. The prestressing of highways and runways by posttensioning, with this novel tendon will increase their productive life several times by reducing the erosion of slab joints resulting from freezing and thawing as well as the corrosion caused by salt and acid rain.

It is, accordingly, evident that the shortcomings of the previously above-discussed prior art devices have been successfully overcome by the provision of the novel tendon construction of the present invention. In addition, these advantages are provided in a straightforward construction which is of competitive or lower initial cost yet provides longer life and generally higher operating efficiency.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A tendon for use in poststressing concrete comprising a multiple-wire strand wherein individual peripheral wires roughly abut each other to define a roughly geometric overall cross-sectional strand configuration having both internal and external interstices wherein said interstices are open ended crevices defined between adjacent wires, an encasement formed of a plastic completely surrounding the outside of said strand to form a smooth outer surface of circular cross-sectional configuration and having internal portions extending into said strand crevices, a thin friction reducing layer of grease-like material on the outer surface of said encasement and a plastic jacket disposed over said encased strand whereby said strand may freely move longitudinally relative to said jacket.

2. The tendon of claim 1, the plastic material of said encasement having high dielectic and low moisture absorption properties.

3. The tendon of claim 1 wherein said encasement substantially completely fills said crevices but does not extend into said internal interstices.

4. The tendon of claim 1 including a rip cord positioned longitudinally along said strand and positioned at least partially beneath said encasement whereby a portion of said encasement, grease layer, and jacket may be longitudinally cut and removed from said strand to thus expose a clean ungreased length thereof.

5. The tendon of claim 1 wherein the wires of said strand are formed of high-tensile steel.

6. The tendon of claim 1 wherein a plurality of shallow longitudinally directed grooves are radially spaced about the outer surface of said encasement for receipt of reservoirs of grease.

7. The tendon of claim 2, said plastic encasement material completely filling the strand outer interstices to a diameter greater than said strand so as to effectively prevent the strand from cutting through the jacket during tensioning which would undesirably result in direct contact with the concrete thus exposing the steel to corrosive attacks of electrolysis and chemical action caused by salt, acids or alkalines present in the concrete or joints of abutting concrete pours.

8. The tendon of claim 3, wherein a lubricating medium is loaded into the internal intertices of said strand to essentially fully fill such internal intertices.

9. The process of making a tendon for use in poststressing concrete comprising shape extruding a molten plastic dielectric material about the bare outer surface of a multiple-strand wire strand having both internal and external interstices wherein said external interstices are open-ended crevices defined between adjacent wires so that said material substantially fully enters said crevices and forms a regular smooth outer material surface of circular cross-sectional configuration which completely encases said strand thereafter coating the outer surface of said thus formed encasement with a thin layer of a friction reducing grease-like material and thereafter melt extruding a seamless plastic jacket around said encased and greased strand.

* * * * *